United States Patent [19]

Coffman

[11] Patent Number: 4,780,343

[45] Date of Patent: Oct. 25, 1988

[54] DECORATIVE BOW STORABLE IN A FLAT CONFIGURATION

[76] Inventor: Gerald C. Coffman, 1835 NE. Second St., Bend, Oreg. 97701

[21] Appl. No.: 82,077

[22] Filed: Aug. 4, 1987

[51] Int. Cl.[4] ..... D04D 7/10

[52] U.S. Cl. ..... 428/5; D9/334; 223/46

[58] Field of Search ..... 428/4, 5; 362/253, 806; 223/46; D9/334

[56] References Cited

U.S. PATENT DOCUMENTS

| | | | |
|---|---|---|---|
| 2,387,173 | 10/1945 | Nufer | 428/4 X |
| 2,471,590 | 5/1949 | Southgate | 428/5 |
| 2,792,655 | 5/1957 | Kroczynski et al. | 428/4 |
| 2,910,794 | 11/1959 | Lockridge | 428/4 |
| 3,850,293 | 11/1974 | Scaringi | 428/5 X |
| 4,726,509 | 2/1988 | Fonas | 428/4 X |

*Primary Examiner*—Henry F. Epstein

*Attorney, Agent, or Firm*—Chernoff, Vilhauer, McClung & Stenzel

[57] ABSTRACT

A decorative device simulating a decorative bow knot in ribbon includes a base member and individual pieces which may be bent into a loop configuration, with each of the loop-configured pieces attached to the base member by corner portions which extend through slits defined in the base member. The slits are preferably of two-legged "V" configuration in order to grip the loop members resiliently, and adhesive material may be used to hold the loop members in an arcuate loop configuration and to attach the loop members to the base member. The bow may be made in large sizes and is suitable for outdoor use at a modest cost. The decorative bow may be disassembled and stored flat as a set of parts.

24 Claims, 3 Drawing Sheets

DECORATIVE BOW STORABLE IN A FLAT CONFIGURATION

BACKGROUND OF THE INVENTION

The present invention relates to decorative devices and particularly to a set of parts in a generally flat configuration which can be assembled easily to resemble a multi-looped ribbon bow.

Decorative bow knots have long been made in ribbons used to secure gift packages. A certain amount of skill and dexterity is required to make attractive bow knots which contain more than a single pair of loops of such ribbon, and fancy hand-tied bows of ribbon may therefore be quite costly. Simulated bow knots are commercially available at low cost in which a number of loops of ribbon are stapled or similarly fastened to a backing member, with the individual loops separated angularly so that the device resembles a multi-looped bow knot. The base member of such a bow can be fastened decoratively to a package by the use of an adhesive layer. Such bows, however, are of quite limited size and occupy a significant amount of space if stored.

Ribbon bows for gift packages can also be made by machines which are able to use fabric ribbon of readily available widths, for example up to about an inch wide. Such bows are also limited in size, however, to rosette diameters of a few inches.

While large bows can be made by tying appropriate ribbon, the ribbon material of which such bows must be made, to be attractive, is quite costly, and the process of tying such bows in an attractive form is difficult and time-consuming. Furthermore, such hand-tied bows occupy large amounts of space if stored for possible reuse, and are not likely to have as good an appearance when reused as when freshly tied.

Decorative bows of much larger size than those currently available could be used attractively in advertising and sales displays such as in automobile showrooms and similar locations, to attract attention to large products offered for sale.

Artificial flowers have been made of ribbon passed through circular holes arranged on a disc-like base, as shown in Wilson U.S. Pat. No. 1,542,432, but these artificial flowers are not easily disassembled for reuse or storage and do not have the appearance of a hand-tied ribbon bow.

What is desired, then, is a structure for large decorative bows having multiple loops, which present an attractive, rosette-like appearance. Such bows should be relatively inexpensive by comparison to hand-tied ribbon bows of similar size and should be easily assembled and able to be disassembled into a conveniently storable flat configuration. Preferably, such bows should also be able to withstand inclement weather.

SUMMARY OF THE INVENTION

The present invention answers the needs set forth above by providing an easily constructed decorative bow device simulating a ribbon bow, which can be made in sizes ranging from a diameter of a few inches or less to a diameter greater than three feet, but with similar proportions. A flat base member of the decorative bow of the invention is of a stiff material such as cardboard or a suitable plastic sheet material, and may be circular or polygonal, with one preferred shape, for example, being a regular pentagon. Slits are provided in the base member to receive portions of each of a plurality of pieces of sheet material each bent into an arcuate configuration to simulate a loop of ribbon of a hand-tied ribbon bow, although the present invention permits construction of a decorative bow of much larger size than is practical for construction of a bow of fabric ribbon tied as a bow knot. Preferably, the slits are two-legged, having the shape of a "V" with its vertex pointing radially outward from a central portion of the base member. The angle of the "V" defined by each slit is made small enough to leave ample material of the base member between adjacent slits, and the slits are preferably arranged in concentric rings to receive loop members so as to form a rosette-like decorative bow.

Loop members, which are strips of generally flat sheet material, are bent arcuately, and their opposite ends are held together in crossing overlying registration to form each of the individual loops. The material of each loop member is chosen for flexibility combined with sufficient stiffness to be self-supporting in an arcuate form resembling a loop of a bow of ribbon.

It is therefore a principal object of the present invention to provide a manner of constructing a large decorative bow for use in showrooms and similar displays at a reasonable cost.

It is another object of the present invention to provide a large decorative bow which may easily be disassembled, stored, and later reused, with no significant change in appearance resulting from such storage.

Yet a further object of the present invention is to provide a large decorative bow device capable of being used for outdoor display without easily being damaged by the elements.

It is a principal feature of the decorative bow device of the present invention that it provides a combination of a base member and a plurality of individual loop members of sheet material which can easily be assembled into a decorative bow device and again disassembled into a flat configuration for subsequent storage.

Another feature of the present invention is the inclusion in the base member of slits having two legs which meet at an angle so as to provide support for a respective loop member while also gripping the loop member to retain it in position in the base member.

A further feature is the provision of an arrowhead-shaped point adjacent one end, and a slot defined adjacent the opposite end.

A principal advantage of the present invention over previously available decorative bows is that it provides a reusable bow in relatively large sizes at a cost less than that of a hand-tied bow of fabric which cannot be reused.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
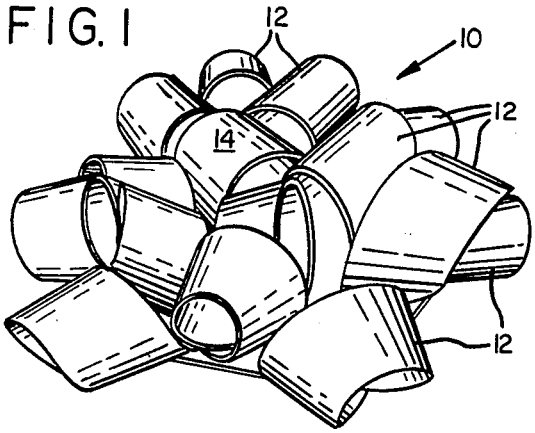
FIG. 1 is a perspective view of an assembled decorative bow device according to the present invention.
Figure 2:
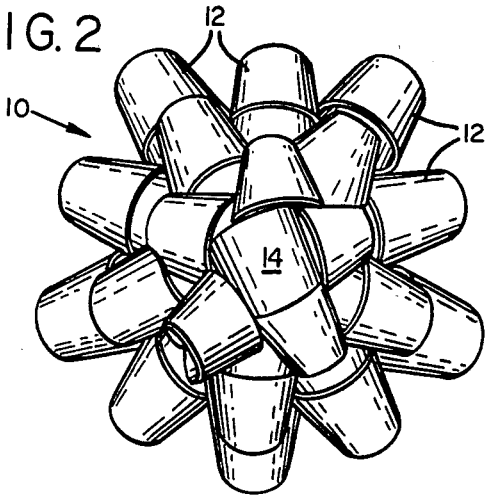
FIG. 2 is a top view of the bow shown in FIG. 1.

Referring to the drawings, FIGS. 1 and 2 show a decorative bow 10 which embodies the present invention. The bow 10 includes a plurality of loop members 12 arranged in four concentric rings each containing five of the loop members 12, together with a single loop member 14 located in the center of the bow 10, all releasably attached to a base member 16 (see FIGS. 3 and 4). The bow 10 may be made in any desired size, from a size having a diameter of less than two inches to a diameter greater than three feet, if desired, and may be disassembled for shipment or storage as a flat set of parts.

In the embodiment of the invention shown in FIGS. 1 and 2, five loop members 12 are located in each of four concentric rings, with the individual loop members 12 of each ring being evenly spaced angularly with respect to the center of the bow 10.

Figure 3:
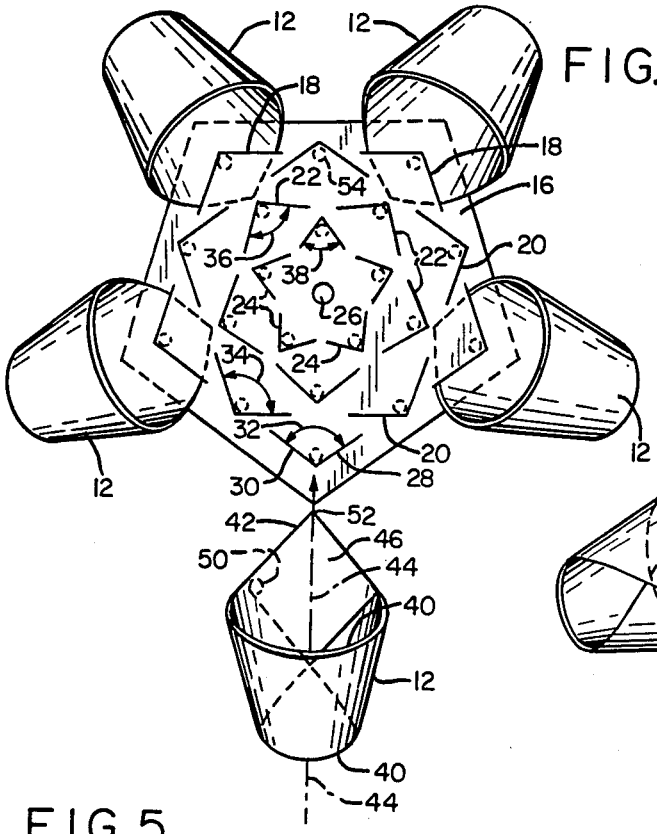
FIG. 3 is a top plan view of a partially assembled decorative bow according to the present invention.
Figure 4:
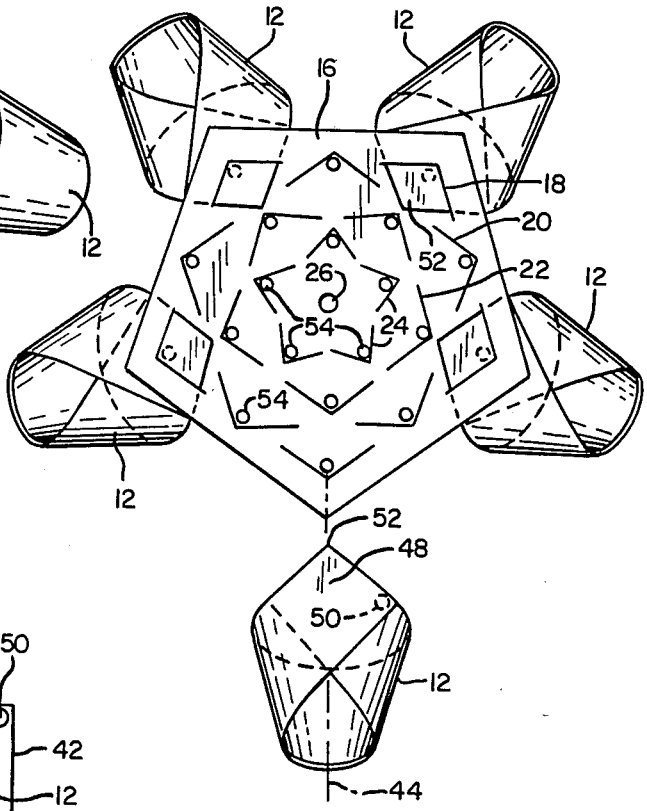
FIG. 4 is a bottom plan view of the bow shown in FIG. 3.

The construction of the bow 10 may be seen with greater clarity by referring to FIGS. 3 and 4. A flat base member 16 of a sheet material is in the form of a regular pentagon and includes five "V"-shaped slits 18 of an outermost ring, five slits 20 of a second ring, five slits 22 of a third ring, and five slits 24 of an innermost ring. A center of the base member 16 is indicated by reference numeral 26, and each of the rings of slits is centered about the center 26 of the base member. The slits 18, 20, 22, and 24 are spaced at equal angular separation from one another within each ring, and the slits 20 and 24 are located at positions bisecting the angles about the center 26, between the individual slits 18 and 22.

Each of the slits 18 includes a pair of legs 28 and 30 which intersect to form an angle 32 defining a "V" shape, with the vertex of the "V" pointing radially away from the center 26 of the base member 16. Similarly, each of the slits 20, 22, and 24 includes a pair of legs which intersect in an included angle 34, 36, or 38, respectively. As shown in FIGS. 3 and 4, the angles 32 and 34, defined by the legs 30 and 28 of the slits 18, and correspondingly by the legs of the slits 20, are of equal size. The angles 36 and 38 of the slits 22 and 24, however, are of smaller size, in order to maintain sufficiently large spaces 39 between the individual ones of the slits 22 and between the individual ones of the slits 24, so that the base member 16 remains as an integral piece of sheet material.

The radial spacing between adjacent ones of the rings of slits may be somewhat less than the width of the individual loop members 12. For example, with a loop member 12 four inches long and 1 inch wide, the radial distance between the slits of the innermost ring and the next ring is approximately ¾ inch. However, as the distance between adjacent slits within a particular ring increases, with increasing radial distance from the center 26, successive rings can be spaced somewhat closer to one another, as is shown in FIGS. 3 and 4.

The base member 16 may be made of any suitably sturdy and stiff, yet slightly flexible and resilient material, such as a cardboard or sheet plastic, depending on whether intended for indoor or outdoor use. The thickness of the base member, to be appropriate, will depend on the overall size of the bow 10.

Figure 5:
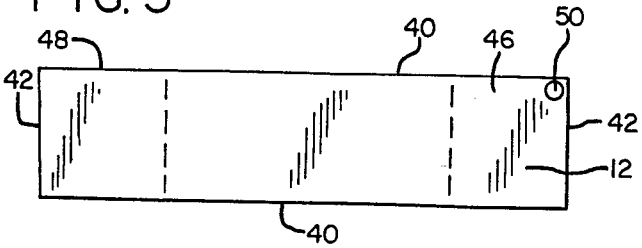
FIG. 5 is a plan view of a loop member which may be used as a part of the decorative bow shown in FIGS. 3 and 4.

As may be seen with reference additionally to FIG. 5, each of the loop members 12 is generally rectangular in shape, having a pair of opposite longitudinal edges 40, and a pair of opposite end edges 42. Ordinarily, the end edges 42 will be perpendicular to the longitudinal edges 40, although it is possible that the loop members 12 may not be rectangular and may not have parallel sides, without departing from the spirit of the invention. As shown in FIGS. 3 and 4, each of the loop members 12 is preferably bent arcuately about a cone axis or bending axis 44 which extends generally transversely with respect to the longitudinal edges 40. Preferably, the loop member 12 is bent into a conical configuration bringing one of the end edges 42 into alignment with one of the longitudinal edges 40. Portions of the loop member 12 overlie one another closely as shown in FIGS. 3 and 4, defining respective opposite end portions 46, 48 of the loop member 12 which are in substantially overlying parallel positions when the loop member 12 has been bent into an arcuately looped configuration, and the end edges 42 are thus respectively aligned with portions of the longitudinal edges 40 within the end portions 46, 48.

A small area of an adhesive material 50 is provided on the end portion 46. Preferably, the adhesive is securely fastened at the location shown in FIG. 5 so as to retain the corner of the opposite end portion 48 so that it will not be loosely exposed. The adhesive preferably is of a reusable type which can be covered protectively when not in use, as by a removable thin sheet of a plastic material. When a loop member 12 is bent into the arcuate configuration shown in FIGS. 3 and 4 the protective sheet (not shown) is removed and the adhesive 50 then holds the opposite end portions 46 and 48 of the loop member together in overlying registration with one another, as shown.

Figure 6:
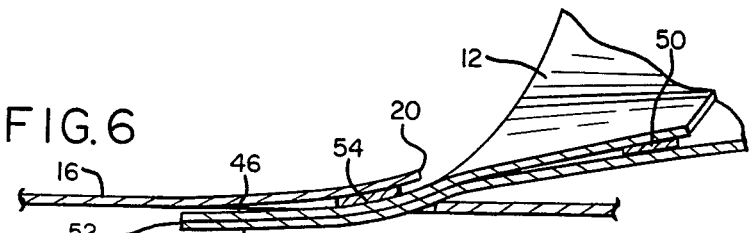
FIG. 6 is a sectional side view of a portion of the base member of a bow according to the present invention, together with a portion of a loop member of the bow.

The overlapping opposite end portions 46 and 48 define a point, or corner 52 which is inserted through a respective one of the slits 18, 20, 22, or 24, to attach each of the loop members 12 to the base member 16, as may be seen in FIG. 6 in greater detail. A small area 54 of an adhesive similar to the adhesive 50 is provided on the bottom side of the base member 16, near the vertex of the respective angle 32, 34, 36, or 38 in order to retain the loop member 12 in position attached to the base member 16.

The loop member 12 may be constructed of a suitably flexible yet self-supportingly stiff and resilient material, the choice of which will depend upon the size of the bow to be constructed according to the invention. For example, for a bow having a diameter of only a few inches, a suitably sturdy fabric such as a grosgrain satin cloth might be used. For larger bows 10, with which the present invention is primarily concerned, however, a fabric material such as acetate satin supported by a transparent layer of acetate mylar plastic sheet material heat laminated to the satin ribbon has been found satisfactory, in terms of durability, self-supporting stiffness, and appearance. Additionally, it is possible to construct loop members 12 of materials which are transparent or of combinations of materials having transparent or translucent portions as desired to provide special effects in the appearance of a bow 10 according to the present invention.

It will be apparent that the use of a loop member 12, having a 4:1 ratio of length to width, with the end edges 42 perpendicular to the longitudinal edges 40, will result in each loop member 12 having the general configuration shown in FIGS. 3 and 4. Variations in the proportions and shape of the loop members 12 are possible without departing from the spirit of the invention, as will be understood. For example, the end edges 42 might be disposed at other than a right angle to the longitudinal edges 40, or the longitudinal edges might be arcuate, so as to give a slightly different appearance of the loop members 12. Such variations will result in consequently different appearance of the resulting loop 12 when the respective end portions 46 and 48 are placed in overlying registration with one another. Nevertheless, the respective end portions 46 and 48 of each loop member 12 are held together in substantially overlying registration defining a point 52 extending through one of the slits 18, 20, 22, and 24 in the base member 16.

Preferably, the combination of stiffness and resiliency of the base member 16 and the stiffness and resiliency of the loop members 12 is such that the slits 18, 20, 22, and 24, and the loop members 12 held respectively within the slits, cooperate with one another and result in the loop member 12 being secured to the base member 16 in an attitude which is appropriate to result in a pleasing appearance of the completed bow.

Figure 7:
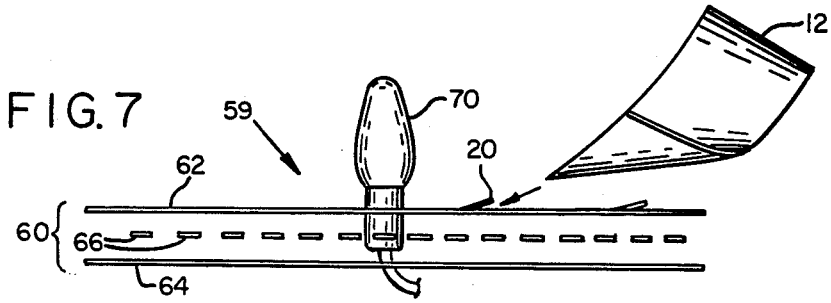
FIG. 7 is an exploded side view of the base member and one loop member of a bow which is an alternative embodiment of the present invention.

In FIGS. 6 and 7, a part of a bow device 59 including base member 60 is shown. The base member 60 is circular and includes a top layer 62 and a bottom layer 64, shown spaced apart in FIG. 7. The layers 62 and 64 may be interconnected with one another by the use of an adhesive in a plurality of small areas of adhesive 66 located between the layers 62 and 64 as indicated in FIG. 8, but should not be adhesively connected over the entire area of the base member 60.

The bottom layer 64, because it is parallel with and close to the top layer 62, tends to force the corner portions 52 of the loop members 12 into a position closer to parallelism with the base member 60 than might be the case were the bottom layer 64 not present, as in the bow 10 shown in FIGS. 1–4. The resulting bow 59 may then be more suitable for certain applications, because of an increased rigidity of the base member 60 by comparison with the base member 16, and by the possibility of using different fasteners on the bottom layer 64 to fasten the resulting bow 59 in a desired location. For example, a bow 59 of such construction might be more suitable than the bow 10 for outdoors use.

As shown in FIG. 7, it is also possible to mount a lamp such as an electric lamp 70 in the center of a bow according to the present invention instead of the center loop 14. Use of such an electric lamp 70 is particularly effective when particular portions of the loop members 12 are of transparent or translucent construction.

Figure 8:
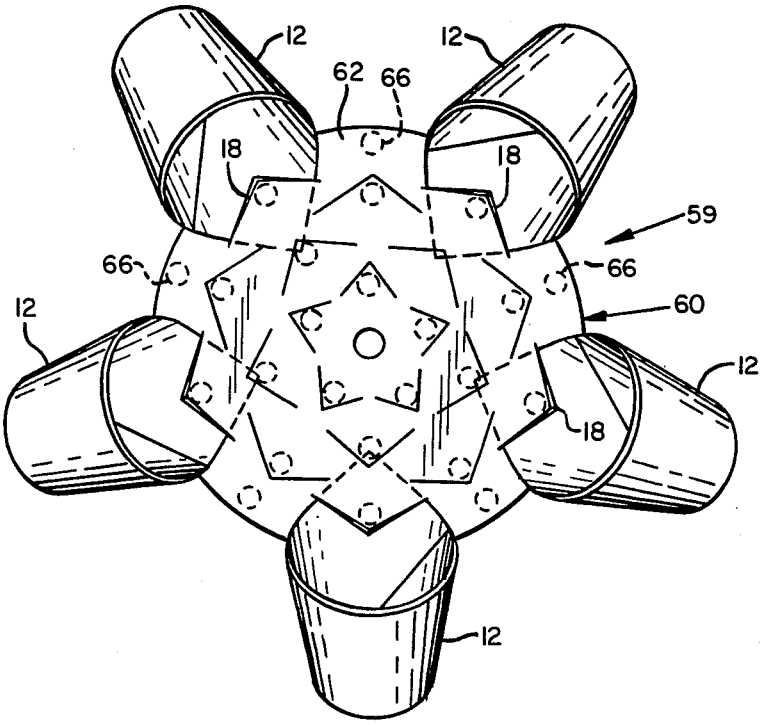
FIG. 8 is a top plan view of a partially assembled bow of the type shown in FIG. 7.

As will be appreciated in view of FIG. 8, the base member 60 may be of a circular plan, rather than the pentagonal plan of the base member 16. It will be appreciated, however, that if the base member extends too far beyond the location of the outermost ring of slits the base member may be visible between the outermost loop members 12 and detract somewhat from the appearance of the completed bow according to the present invention.

Referring now to FIGS. 9–12, a decorative bow 59' is shown which is another embodiment of the present invention.

Figure 9:
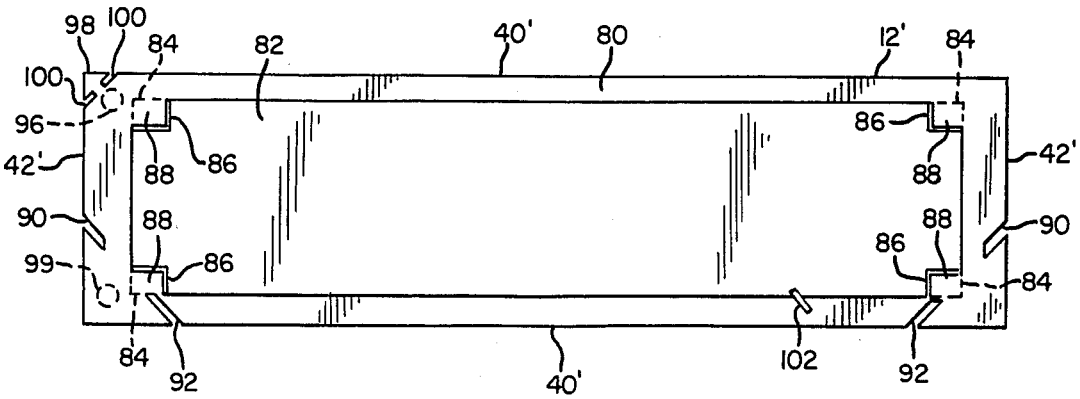
FIG. 9 is a plan view of a decorative bow device which is another embodiment of the present invention.
Figure 10:
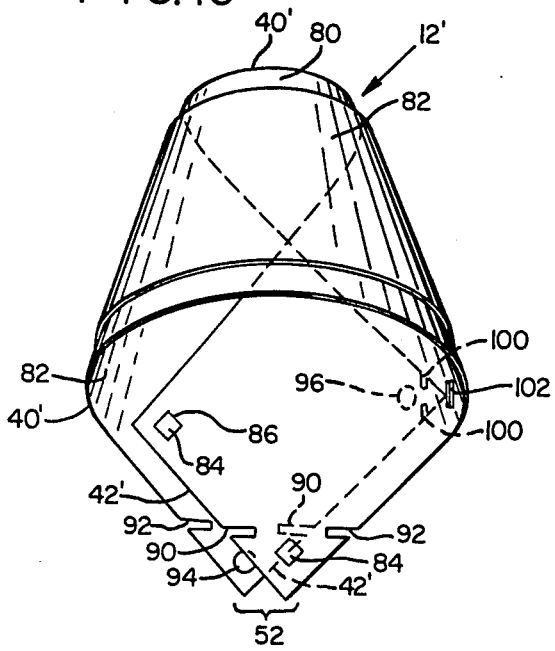
FIG. 10 is a pictorial view showing a loop member such as the one shown in FIG. 9 being bent into an arcuate loop form for use in a decorative bow device according to the present invention.
Figure 12:
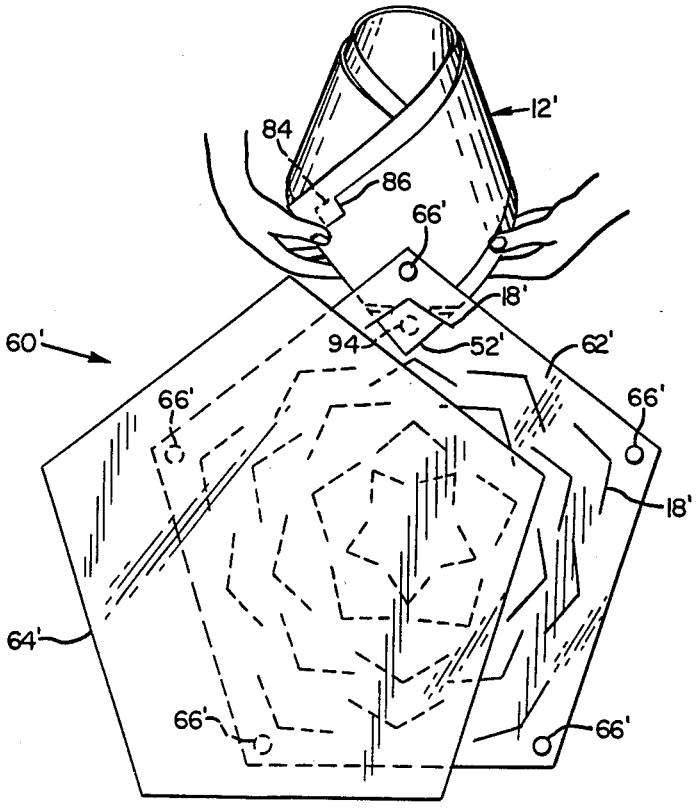
FIG. 12 is a bottom plan view of the base of a decorative bow device according to the present invention, with the top and bottom layers of the base separated from one another, and a loop member being installed.

As shown particularly in FIGS. 9 and 10, a loop member 12' includes a layer of transparent material such as a 0.003 inch thick sheet 80 of an acetate mylar clear plastic material and a smaller rectangular piece of woven fabric 82, such as an acetate satin ribbon material. The woven fabric 82 may be attached to the sheet 80 by having its corners 84 tucked through openings defined in the sheet 80, such as by the slits 86 which include a pair of legs at right angles to one another, defining respective triangular flaps 88 of the sheet 80, beneath which the corner portions 84 of the ribbon 82 may be placed to be held by the resiliency of the sheet 80. Alternatively, a pair of sheets 80, each including a single adhesive facing, may be laminated together with the ribbon material 82, to define a loop member 12' of the same shape, but without the need for the slits 86.

A notch 90 is provided in each end edge 42', and a notch 92 is provided proximate each end of the loop member 12' in one of the longitudinal edges 40' of the loop member 12'. The notches 90 and 92 at each end of the loop member 12' are aligned toward one another, diagonally across the corner defined by the intersection of the respective end edge 42' and the longitudinal edge 40', so that when the loop member 12' is arcuately bent as explained previously with respect to the loop member 12, the notches 90 and 92 align with one another in the point or corner 52', giving an arrowhead-like shape to the point or corner 52', as is shown best in FIG. 11. If desired, a small area 94 of an adhesive material may be provided as shown to retain the two corner portions of the loop member 12' together, and a similar area 96 of adhesive material may be provided in the other corner adjacent the same end of the loop member 12', to hold that corner of the loop member in contact with the surface of a portion of the loop member 12 near the opposite end of the loop member 12.

Preferably, at one end of the loop member 12', instead of or in addition to the area 96 of adhesive material, a tab portion 98 is defined, as by a pair of notches 100 defined in the respective end edge 42' and longitudinal edge 40' proximate their point of intersection. An aperture 102 is provided through the loop member 12', proximate the opposite end of the loop member 12', but spaced apart from the end edge 42' by a distance approximately equal to the length of the end edge 42' on which the tab 98 is defined. When the loop member 12' is bent into an arcuate loop configuration as is shown in FIG. 10, the tab 98 may be positioned lockingly within the aperture 102 to serve the same purpose explained previously with respect to the adhesive 96.

Figure 11:
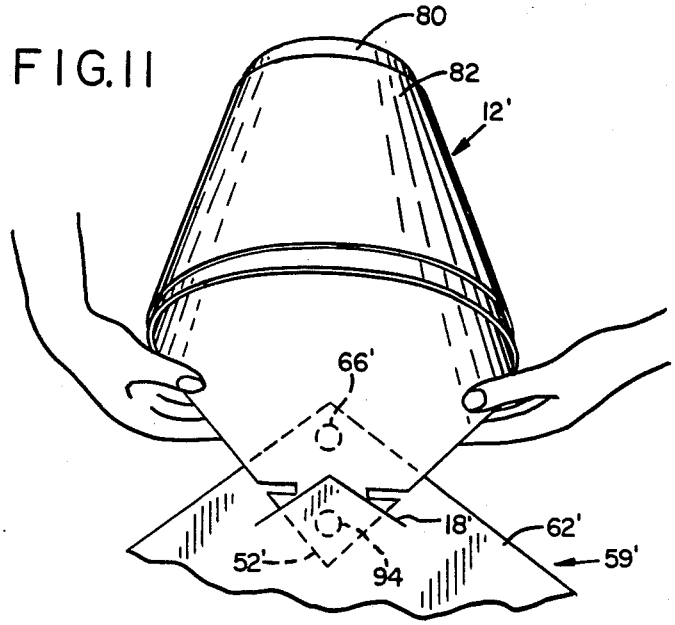
FIG. 11 is a top plan view of a portion of the base member and one of the loop members of a bow which is another embodiment of the invention.

When the loop member 12' has been bent into the arcuate configuration desired, with the point or corner 52' properly formed, the point 52' can be inserted into the appropriate slit, such as the slit 18', in the top layer 62′ of the base member 60, as shown in FIG. 11. When the point 52′ has been inserted far enough into the slit 18′, the notches 90 and 92 will permit the point 52′ to lock into place beneath the top layer 62′, to retain the loop member 12′ in place.

When all of the loop members 12′ for the decorative bow device 59′ have been inserted in their respective slots, the bottom layer 64′ may be attached to the top layer 62′ by the areas 66′ of adhesive material.

Preferably, the base member 60′ is constructed of transparent plastic material, for example, transparent acetate mylar sheet plastic of a thickness giving the appropriate amount of stiffness, depending upon the size of the bow device 59′. Such transparency of the base portion 60′ permits the color of an object on which the decorative bow device 59′ is placed to be visible.

Not only is the decorative bow constructed according to the present invention attractive in appearance, but it is relatively inexpensive to manufacture. Furthermore, because of the materials which may be used in its construction it may be disassembled easily, with each of the loop members 12 being opened into a flat configuration, making the entire bow easily storable as a flat package in a minimum amount of space.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A decorative bow assembly, comprising:

(a) a base member defining a plurality of slits arranged in a predetermined pattern about a central point; and (b) a plurality of loop members, each comprising an elongate piece of flexible sheet material having a pair of opposite longitudinal edges, a pair of opposite end edges extending between the longitudinal edges, and opposite end portions proximate the end edges, said elongate piece of flexible sheet material being bent into the form of an arcuate loop, with said opposite end portions in overlying proximity to each other, and each of said plurality of loop members being attached to said base member with both end portions of said elongate piece of flexible sheet material extending through a respective one of said slits.

2. The bow of claim 1 wherein as to at least one of said loop members, said opposite end portions of said piece of flexible sheet material are in substantial registration, the respective end edge of one of said opposite end portions being aligned with a portion of a longitudinal edge of said piece of flexible sheet material within the other one of said opposite end portions.

3. The bow of claim 1 wherein said pieces of flexible sheet material are rectangular.

4. The bow of claim 3 wherein said rectangular pieces of flexible sheet material are about four times as long as they are wide.

5. The bow of claim 1 wherein said slits are arranged in a generally circular pattern.

6. The bow of claim 5 wherein said circular pattern includes a plurality of concentric rings of said slits, each of said slits extending generally circumferentially of its respective ring.

7. The bow of claim 1, including an illuminating device located proximate said central point on said base member.

8. The bow of claim 1 wherein at least some of said slits include a pair of substantially straight legs interconnected with each other to define an included angle therebetween.

9. The bow of claim 1, each of said loop members having adhesive means located in one of said opposite end portions for holding said opposite end portions together to retain said loop member in said form of an arcuate loop.

10. The bow of claim 1 wherein said longitudinal edges are parallel with each other.

11. The bow of claim 1, at least one of said loop members defining a pair of notches defining a tab portion adjacent a first end thereof and including an aperture located proximate a longitudinal edge thereof and spaced apart from a second end thereof a distance approximately equal to the width of said loop member, said tab portion being received in said aperture when said loop member is in said form of an arcuate loop.

12. The bow of claim 1 wherein at least one of said loop members includes a respective first notch defined in each end edge and a pair of second notches defined in a longitudinal edge, each said second notch being located adjacent a respective end edge, and each of said first notches being substantially in registration with one of said second notches when said loop member is bent into said form of an arcuate loop.

13. The bow of claim 1 wherein said base member includes a top layer and a bottom layer, said slits being defined in said top layer.

14. The bow of claim 13 wherein said top layer and bottom layer are interconnected by an adhesive which is releasable from at least one of said top and bottom layers.

15. The bow of claim 1, including respective securing means located on said base member proximate each of said slits, for retaining a respective one of said loop members engaged in said slit.

16. The bow of claim 15 wherein said securing means includes a quantity of an adhesive which is securely attached to said base member, but releasable from said loop members.

17. The bow of claim 1 wherein each of said slits includes a pair of legs which meet each other defining an included angle, said bow including securing means attached to said base member within said included angle, for fastening a respective one of said loop members to said base member with a respective portion of said loop member engaged in a respective one of said slits.

18. The bow of claim 17 wherein said securing means includes a quantity of adhesive material attached to said base member.

19. The bow of claim 18 wherein said adhesive material is of a type which adheres releasably to said loop members.

20. The bow of claim 1 wherein some of said loop members include a layer of satin fabric protected and supported by a layer of transparent plastic sheet material.

21. A set of parts for use in constructing a decorative bow, comprising:

(a) a generally flat base member of sheet material having a center location and defining a plurality of slits arranged substantially symetrically about said center location and extending through a portion of said base member;

(b) a plurality of elongate loop members of sheet material separate from said base member each including a pair of longitudinal edges and a pair of end edges interconnecting said longitudinal edges, said pieces of sheet material being flexible, but self-supporting when bent to a smoothly arcuate configuration about a bending axis extending substantially transversely with respect to said longitudinal edges; and (c) said slits each being of a size appropriate to receive and to hold snugly a portion of a respective one of said loop members in said arcuate configuration.

22. The set of parts of claim 21 wherein said base member includes a top layer defining said slits and an attached bottom layer free of slits and generally coextensive with said top layer.

23. The set of parts of claim 21 wherein said slits are arranged in a plurality of concentric rings about said center location, each ring including a plurality of said slits and each of said slits extending generally circumferentially of the respective ring of which it is a part.

24. The set of parts of claim 21 wherein said base member is transparent.

* * * * *